US005590512A

United States Patent [19]

Richards et al.

[11] Patent Number: 5,590,512

[45] Date of Patent: Jan. 7, 1997

[54] APPARATUS FOR USING PACKS OF FLEXIBLE TUBING IN PACKAGING

[75] Inventors: David C. Richards, Berkshire; Maurice S. Williams, Cranleigh; Brian Ward, Berkshire, all of United Kingdom

[73] Assignee: Melrose Products Limited, Guernsey, United Kingdom

[21] Appl. No.: 518,993

[22] Filed: Aug. 24, 1995

[30] Foreign Application Priority Data

Aug. 26, 1994 [GB] United Kingdom ..... 9417373

[51] Int. Cl.[6] ..... B65B 9/10

[52] U.S. Cl. ..... 53/567; 53/576; 53/370

[58] Field of Search ..... 51/551, 576, 567, 51/370

[56] References Cited

U.S. PATENT DOCUMENTS 4,505,003 3/1985 Becker et al. ..... 53/576

4,869,049 9/1989 Richards et al. ..... 53/576

FOREIGN PATENT DOCUMENTS 0303517 2/1989 European Pat. Off. .

2364180 7/1974 Germany ..... 53/576

1265328 3/1972 United Kingdom .

2206094 12/1988 United Kingdom .

*Primary Examiner*—Linda Johnson

*Assistant Examiner*—John Paradiso

*Attorney, Agent, or Firm*—Shoemaker and Mattare, Ltd.

[57] ABSTRACT

A series of packages containing different sized objects are formed by pushing the objects in series into a funnel shaped portion of flexible tubing drawn from pack over the rim of a funnel. Each object pushes a preceding package from between spring-loaded jaws to take its place. Each package is closed at the top by twisting the tubing by turning the funnel fixed to the pack about its axis.

6 Claims, 3 Drawing Sheets

APPARATUS FOR USING PACKS OF FLEXIBLE TUBING IN PACKAGING

FIELD OF THE INVENTION

This invention relates to apparatus for using packs of flexible tubing in packaging and more particularly to packaging a series of objects respectively in individual packages along a length of such flexible tubing.

The invention is particulary applicable to the disposal of waste material and a main object of the invention is to provide for the ready disposal of personal waste material such as babies' disposable nappies, tampons or other sanitary towels.

DESCRIPTION 0F THE PRIOR ART

In patent specification No. GB 2206094 there is described apparatus for packaging a series of objects respectively in individual packages distributed along an unbroken length of flexible, substantially non-resilient tubing providing the walls of the packages, the apparatus comprising tubular guide means arranged to receive a pack of said flexible tubing when formed into a gathered tube and to enable one end of the tubing in the gathered pack to be drawn away from the gathered pack and passed over the end of the tubular guide means when the latter is surrounded by the gathered pack and then coaxially downwards through the tubular guide means so that the outer surface of the flexible material in the pack becomes the cylindrical inner surface of the flexible material passing through the tubular guide means, the end of the flexible tubing being initially open until sealed to form the base of a first package having the flexible tubing as its side wall, the apparatus being arranged for the base to be thrust along the tubular guide means by an object to be packaged, while further flexible tubing is as a consequence drawn from the pack over the end of the tubular guide means into the tubular guide means to envelop the object to be packaged when located at least partly in the tubular guide means, means beyond the tubular guide means being provided for manually twisting the flexible tubing beyond an object when so located to close and thereby complete a package comprising that object and so provide the base for a further package for a further object to be thrust into the tubular guide means, whereby objects can be packaged in series along the length of unbroken tubing and at least an element being arranged to co-operate with each object to be packaged to hold the enveloping tubing against axial rotation during the said twisting.

The objects referred to above may be single objects or discrete collections of items, dry, damp or very wet.

SUMMARY OF THE INVENTION

While the apparatus described above has proved to be very satisfactory for ordinary family use, in the case of use by widely disassociated people, as in a hospital, it is necessary to reduce to the greatest possible extent any risk of cross infection. It is therefore a main object of the present invention to achieve this.

Another object of the present invention is to enable an increased size range of the objects to be accommodated in a single length of flexible tubing, these being accepted by the apparatus continuously without adjustment.

According to the present invention, apparatus for packaging a series of objects respectively in individual packages distributed along a length of flexible, substantially non-resilient tubing providing the walls of the packages, comprising tubular guide means having an entrance funnel with a rim at its inlet end and arranged to receive a gathered pack of said flexible tubing when located about said guide means to enable one end of the tubing in the gathered pack to be drawn away from an end of the gathered pack over said rim over the inside surface of said funnel and through a further length of said tubular guide means so that the outer surface of the flexible material in said pack becomes the cylindrical inner surface of the flexible material passing through said tubular guide means, the said one end of the flexible tubing having been sealed to form the base of a first package having the flexible tubing as its side wall, the apparatus being arranged for the base to be thrust, as by an object to be packaged, along said tubular guide means while further flexible tubing is drawn from the pack, over said rim into said tubular guide means providing space for an object to be packaged when located in or beyond said tubular guide means, and means being provided for holding an object to be packaged against rotation about its axis while the flexible tubing to the rear of that object is manually twisted to close the package, characterised by the feature that said funnel is flared outwards to said rim so that said flexible tubing drawn over said rim passes over a convergent area of the flared inside surface of said funnel and the funnel is mounted for axial rotation by manual application to said rim to twist said flexible material when required to close a package, the width of said funnel at said rim being sufficiently great to present an unsoiled layer of the flexible material on the funnel surface.

BRIEF DESCRIPTION OF THE DRAWINGS

In order that the invention may be clearly understood and readily carried into effect apparatus in accordance therewith will now be described, by way of example, with reference to the accompanying drawings, in which.

DESCRIPTION OF PREFERRED EMBODIMENT OF INVENTION

Figure 1:
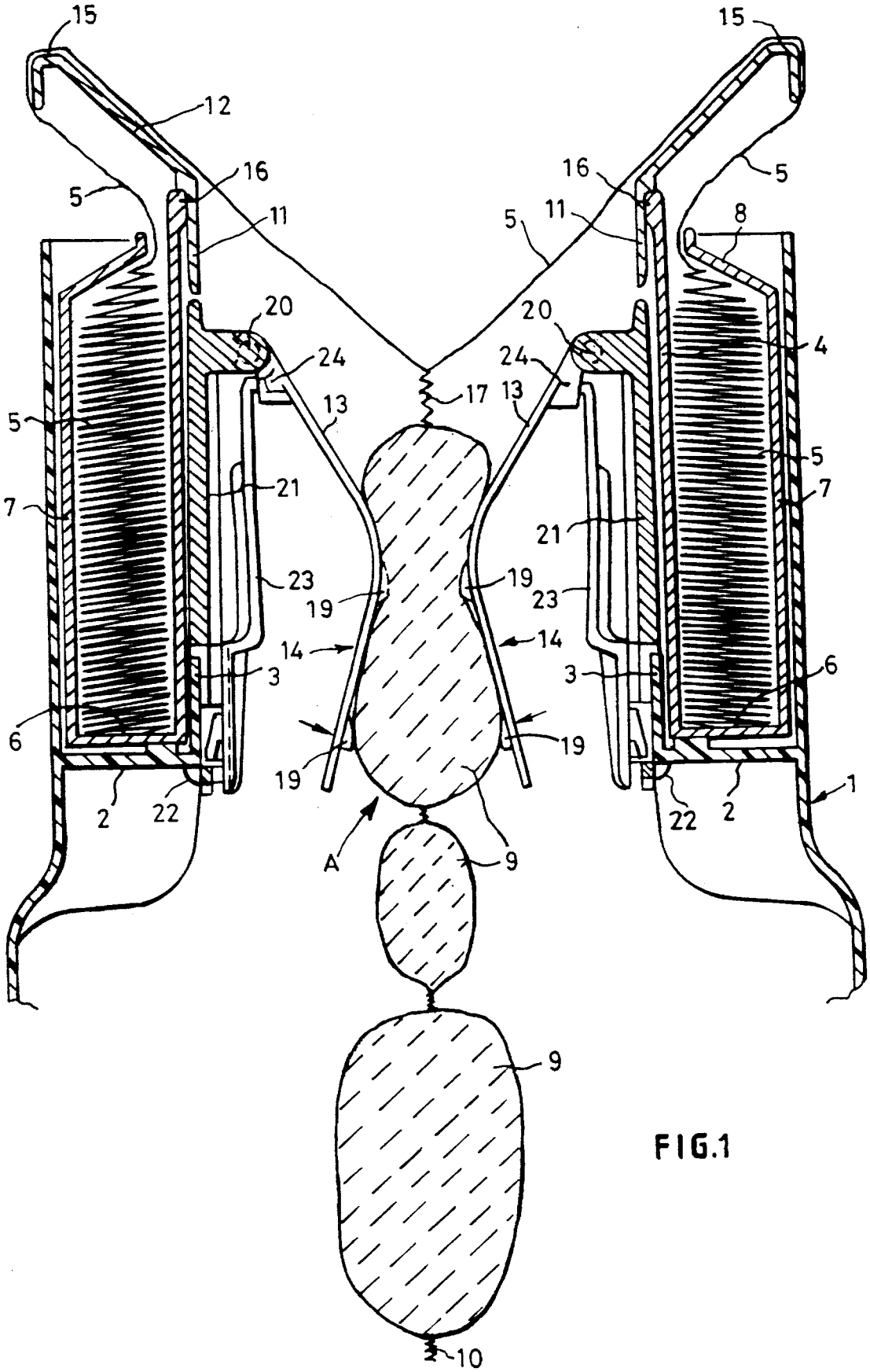
FIG. 1 is a sectional elevation of apparatus for packaging a series of objects respectively in individual packages distributed along a length of flexible tubing.

Referring to FIG. 1 is a cylindrical container 1 is formed with an internal flange 2 from which a short cylinder 3 extends upwards. A pack consisting of a tubular core 4 inside a profusely circumferentially pleated length of flexible tubing 5 is located inside the container 1 with the core 4 supported by the flange 2 and rotatable on the cylinder 3. The core 4 has a flange 6 that supports the pleated tubing which is surrounded by a sleeve 7. An angle section ring 8 is located above the pleated tubing, sufficient clearance from the core 4 being provided to enable the tubing to be drawn upwards from the pack.

To begin using the pack to form a series of packages 9 of objects, the top of the flexible tubing is pulled upwards away from the pack and tied into a knot 10 (FIG. 1). This closed end can then form the bottom of a package to be formed along the length of part of the tubing. This is effected by pushing the closed end downwards by means of an object to be packaged through the narrower end 11 of a flared funnel 12 so that it passes between two converging surfaces 13 of spring loaded jaws 14 and forces them apart until this package as yet unclosed reaches position A (FIG. 1) where it is gripped by the jaws 14. As this is being done the flexible tubing 5 continues its passage from the pack over the inlet edge 15 of the funnel 12 to present a fresh and hygienic layer of the tubing in the flared part of the funnel.

The funnel 12 is detachably fixed to the top of the core 4 by a taper joint 16. When the object has reached position A the package is closed by twisting the flexible tubing 5 about the funnel axis at 17. This is done by turning the funnel together with the core 4 and other parts of the pack about that axis. This can easily be done by finger and thumb acting on the edge 15 of the funnel. During this action the package at A is prevented from axial rotation by the jaws 14. When the next object is to be packaged it is pushed against the closed end of the package at A so as to dislodge that package downwards and take its place. This operation can be repeated to provide a series of packages along the length of unbroken tubing 5. These packages can be of varying sizes as shown in FIG. 1.

Figure 2:
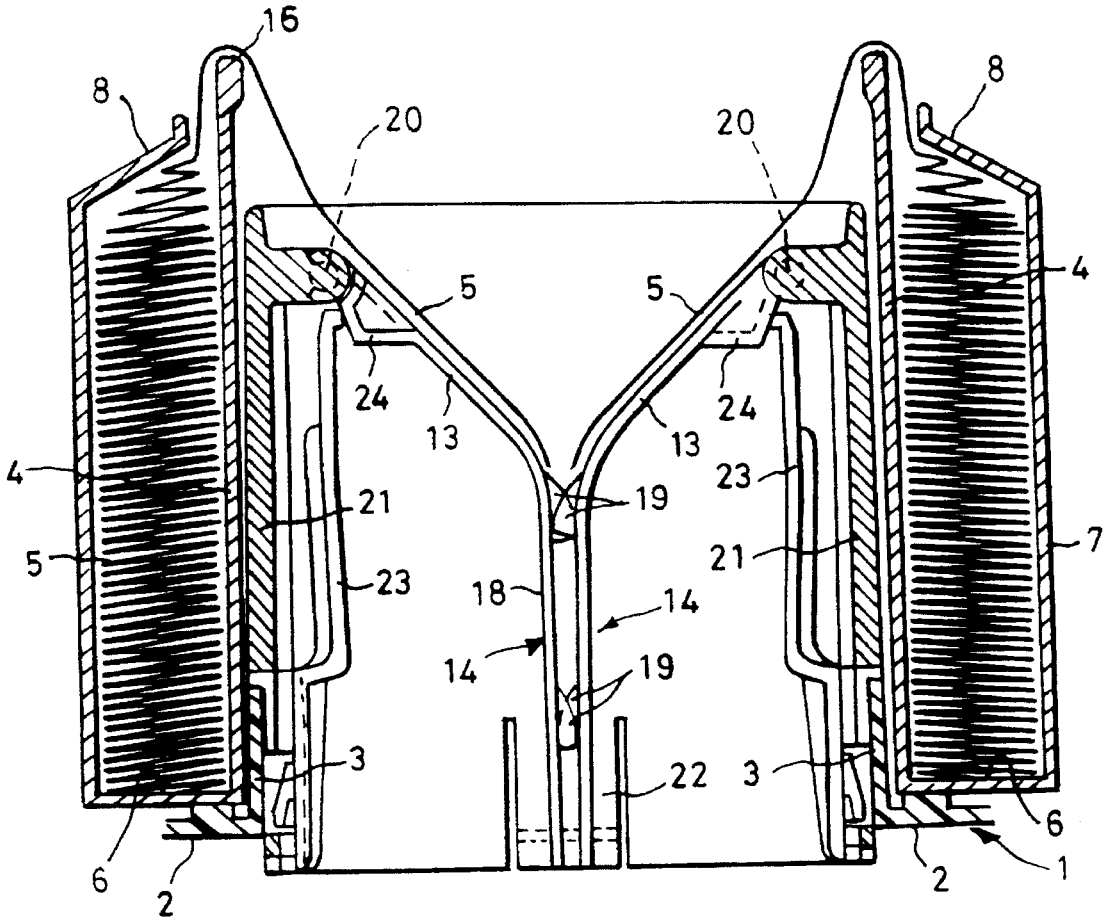
FIG. 2 is a sectional elevation of a portion of the apparatus of Figures shown in greater detail.
Figure 3:
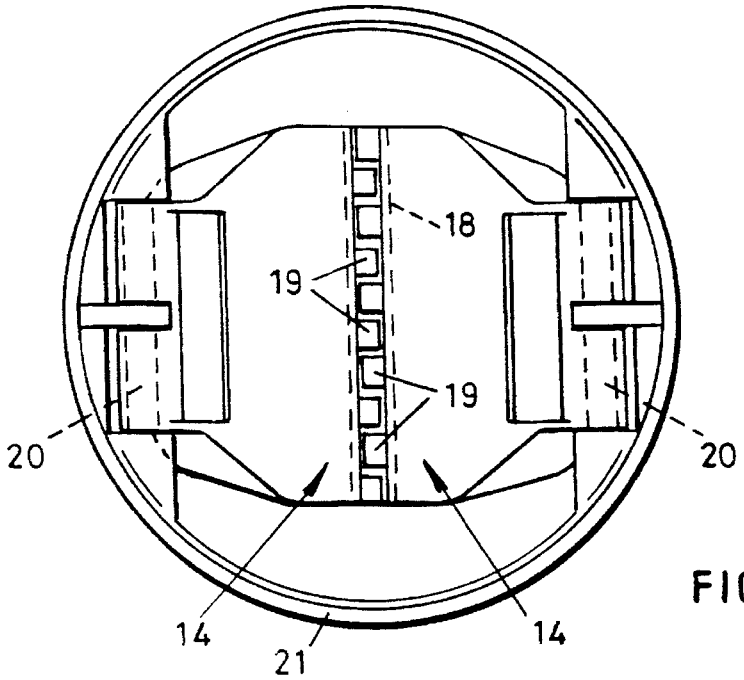
FIG. 3 is a plan of a portion of the apparatus of FIG. 2.
Figure 4:
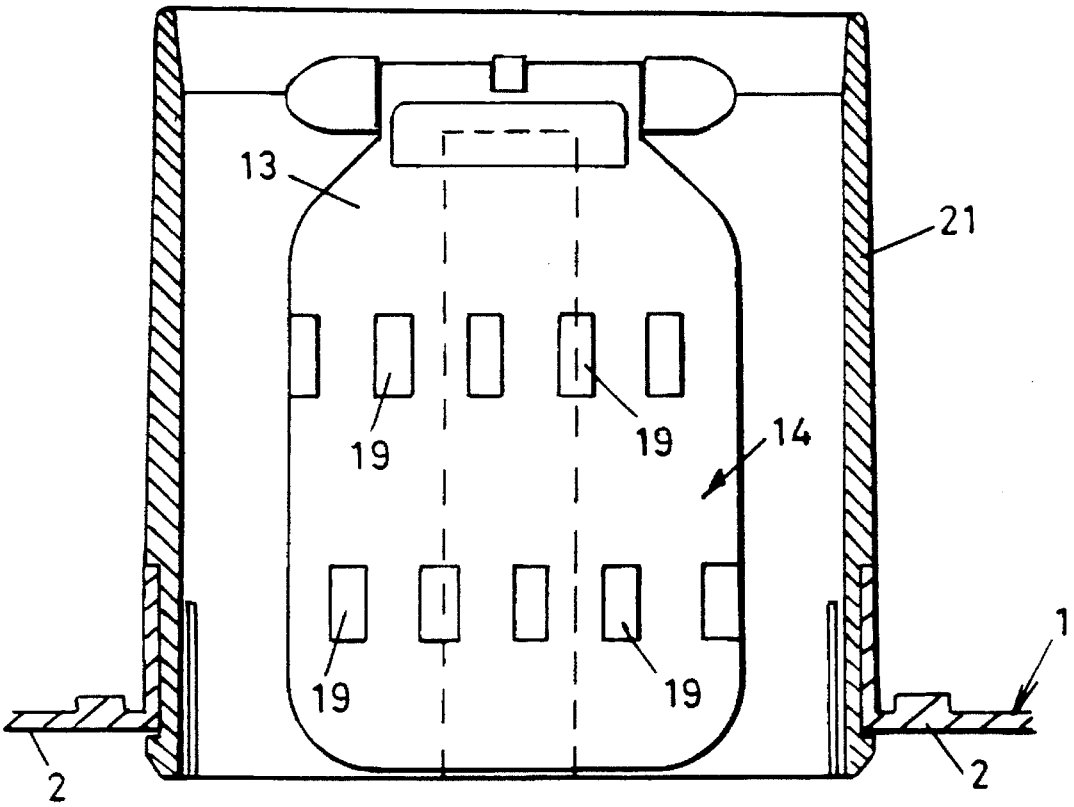
FIG. 4 is a sectional elevation of the apparatus of FIG. 3.

The jaw mechanism will now be described with reference to FIGS. 2, 3, 4. The jaws 14 consist of two plates bent as shown in FIG. 2 to present the converging surfaces 13 leading to vertical (as shown in FIG. 2) surfaces 18, each formed with two rows of teeth 19. When the jaws are closed together each row of teeth on one plate is interdigitated with the corresponding row on the opposite plate. The plates are pivotally mounted above privots 20 on a cylinder 21 detachably mounted inside the pack core 4 by means of catch members 22 engaging beneath the flange 2. Prior to separation, the plates are held in contact with one another respectively by prestressed flat springs 23, each fixed to the cylinder 21 at one end and bearing at the other end against a lug 24 on the associated one of the two plates. When a package is held between the jaws, the stress in each flat spring is further stressed with a useful mechanical advantage such that the spring pressure remains substantially constant.

Figure 5:
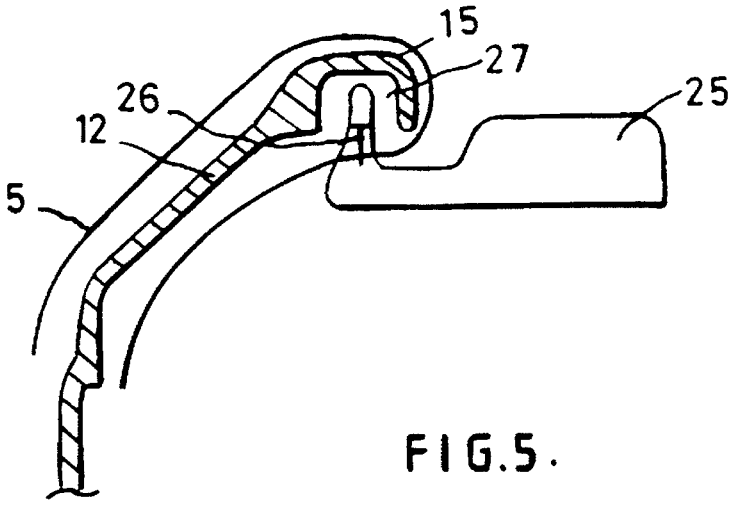
FIG. 5 is a diagram of a detail.

By the aforesaid means a series of connected closed packages can be formed and this can be continued until the pleated tubing 5 is exhausted. However, when it is desired to remove a package that has just been formed or a series of such packages, the package or uppermost package in the series is severed from the remaining tubing. This can be effected by leaving the funnel in situ and using a tool 25 (FIG. 5) with a blade structure 26 similar to that shown in the aforesaid patent specification GB 2206094. An annular groove 27 is formed under the edge 15 of the funnel 12. The tool is used to pierce the tubing material in the groove 27 so that when the funnel is rotated relatively to the tool the tubing is cut all round. If the funnel 12 is omitted from the apparatus ab initio a rotary cutter device as described in GB 2206094 can be used. The teeth 19 on the jaws 14 are shaped so as to inhibit reverse movement of the package without substantially impeding the normal movement in the direction away from the funnel.

The outwardly flared funnel results in substantial reduction of the possibility of cross infection when the apparatus is put to multi-purpose use in, for example, a hospital, creche or nursery. The funnel provides a large entrance for wet soiled diapers or other wet disposable items, fresh virgin tubing material being drawn in to cover the funnel surface as such an item is thrust through the funnel. The rotation of the funnel and pack is easy for a woman with small hands when the tubing is being twisted. The rim of the funnel may be other than circular, such as elliptical.

The entire apparatus may be made from plastics material, except for the blade structure 26. Plastics material with sufficient resiliance can be used for the flat springs 23. It has been found that when the tubing 5 is made of high density polyethylene the twisted joints 17 remain remarkably tight.

We claim:

1. An apparatus for packaging a series of objects respectively in individual packages distributed along an unbroken length of flexible substantially non-resilient tubing providing the walls of the packages, the apparatus comprising tubular guide means including a flared entrance funnel formed with a rim at its wide end and shaped to receive said series of objects as they are manually inserted into said flared entrance funnel, said flared entrance funnel having a tubular wall tapering to a narrower end, a guide cylinder providing a continuation of said flared entrance funnel, said guide cylinder being aligned with said narrower end to lead said series of objects therethrough, means for receiving a cylindrical gathered pack of said flexible tubing when mounted to surround said tubular guide means and to enable the end of said tubing to be drawn away from an end of said gathered pack and to the end sealed and pasted over and through the entire peripheral surface of said rim into and over said tapering tubular wall of said flared entrance funnel and thence through said guide cylinder, whereby the outer surface of said tubing becomes the inside surface thereof inside said tubular guide means and whereby manual pressure on a soiled object to be packaged in the tubing towards said end of said tubing causes said tubing to pass over said rim and along said tubular guide means while more tubing is withdrawn from the pack in a fresh and untouched state, allowing the user the advantage of touching a clean surface of the flexible tubing, means mounted within said guide cylinder for holding the soiled object when in the tubing against rotation about its axis while said withdrawn tubing is manually twisted to close a package containing that soiled object, said holding means comprising a plurality of clamping elements which are normally in a closed and contacting position, each clamping element being movable between a closed position blocking passage of said object and an open position permitting the object to pass, means for resiliently biasing the clamping elements towards the closed position and said flared entrance funnel being rotatable about its axis by manual application of torque to said rim thereby to twist said tubing to close a package held against rotation by said holding means.

2. Apparatus according to claim 1, comprising mounting means for said rotatable funnel whereby said funnel is detachable with respect to said further guide cylinder.

3. Apparatus according to claim 1, in which said clamping elements are two jaws and spring means mounted to exert continuous closing action on said jaws, said two jaws being formed so that, when closed together, they present converging surfaces to be forced apart by the axial thrust of an object inserted between them, and further formed with additional surfaces shaped to hold that object when said thrust is relaxed.

4. Apparatus according to claim 3, in which said additional surfaces comprise teeth shaped to provide easier passage of the object in a direction away from said converging surfaces than in the opposite direction.

5. Apparatus according to claim 4, in which said teeth are are arranged in opposing rows on said jaws and located so that the teeth in each row are inter-digitated with teeth on the opposite jaw when said jaws are close together.

6. Apparatus according to claim 3, in which said jaws are mounted for relative opening and closing movements about pivotal axes respectively close to separated ends of said converging surfaces, and in which said spring means comprise flat springs, each mounted to act on one associated jaw close to its pivotal axis while anchored at a point remote from that axis.

* * * * *